US010577728B2

(12) United States Patent
Pilar

(10) Patent No.: US 10,577,728 B2
(45) Date of Patent: Mar. 3, 2020

(54) METHOD FOR PREPARING A WORKSTATION FOR RESUMPTION OF THE SPINNING PROCESS ON AN AIR-JET SPINNING MACHINE, AND AN AIR-JET SPINNING MACHINE FOR PERFORMING THE METHOD

(71) Applicant: Rieter CZ s.r.o., Usti nad Orlici (CZ)

(72) Inventor: Evzen Pilar, Litomysl (CZ)

(73) Assignee: Rieter CZ s.r.o., Usti nad Orlici (CZ)

( * ) Notice: Subject to any disclaimer, the term of this patent is extended or adjusted under 35 U.S.C. 154(b) by 635 days.

(21) Appl. No.: 15/353,415

(22) Filed: Nov. 16, 2016

(65) Prior Publication Data

US 2017/0137974 A1 May 18, 2017

(30) Foreign Application Priority Data

Nov. 16, 2015 (CZ) ..... PV 2015-816

(51) Int. Cl.
*D01H 1/115* (2006.01)
*D01H 4/02* (2006.01)
*D01H 7/92* (2006.01)

(52) U.S. Cl.
CPC ..... *D01H 1/115* (2013.01); *D01H 4/02* (2013.01); *D01H 7/92* (2013.01)

(58) Field of Classification Search
CPC . D01H 1/115; D01H 4/40; D01H 4/48; D01H 15/00
See application file for complete search history.

(56) References Cited

U.S. PATENT DOCUMENTS 4,995,229 A * 2/1991 Stahlecker ..... B65H 54/026 57/261
5,142,856 A * 9/1992 Nakayama ..... B65H 69/00 57/22
5,327,712 A * 7/1994 Dallmann ..... B65H 51/205 57/22
8,904,742 B2 12/2014 Stephan et al.
(Continued)

FOREIGN PATENT DOCUMENTS

DE 103 47 060 A1 5/2005
DE 10 2012 108 380 A1 12/2013
(Continued)

OTHER PUBLICATIONS

EP Search Report, dated Apr. 26, 2017.

*Primary Examiner* — Shaun R Hurley
(74) *Attorney, Agent, or Firm* — Dority & Manning, P.A.

(57) ABSTRACT

A method for preparing of a workstation of an air-jet spinning machine for the resumption of a yarn spinning process after an interruption includes inserting the yarn end into an inlet opening of the spinning nozzle and transporting the yarn in a reverse motion with aid of the spinning nozzle and a fiber feeding device to a guide channel disposed before the spinning nozzle. A spinning-in yarn end is formed on the yarn in the guide channel. A yarn reserve is formed in an underpressure yarn storage device in from of a yarn winding device. The reverse motion of the yarn to the guide channel is performed by reverse motion of a yarn drawing-off mechanism at the workstation. A workstation configured to perform the method is encompassed by the invention as well.

10 Claims, 1 Drawing Sheet

(56) References Cited

U.S. PATENT DOCUMENTS

| | | | | |
|---|---|---|---|---|
| 2009/0094958 | A1* | 4/2009 | Weide | D01H 1/115 57/263 |
| 2013/0067879 | A1* | 3/2013 | Stephan | D01H 1/24 57/78 |
| 2013/0333347 | A1 | 12/2013 | Stephan et al. | |
| 2014/0283496 | A1 | 9/2014 | Stahlecker et al. | |
| 2017/0137975 | A1* | 5/2017 | Pilar | D01H 4/02 |

FOREIGN PATENT DOCUMENTS

| | | | |
|---|---|---|---|
| EP | 2 679 711 | A1 | 1/2014 |
| EP | 2 784 193 | A1 | 10/2014 |
| JP | S59 211628 | A | 11/1984 |

* cited by examiner

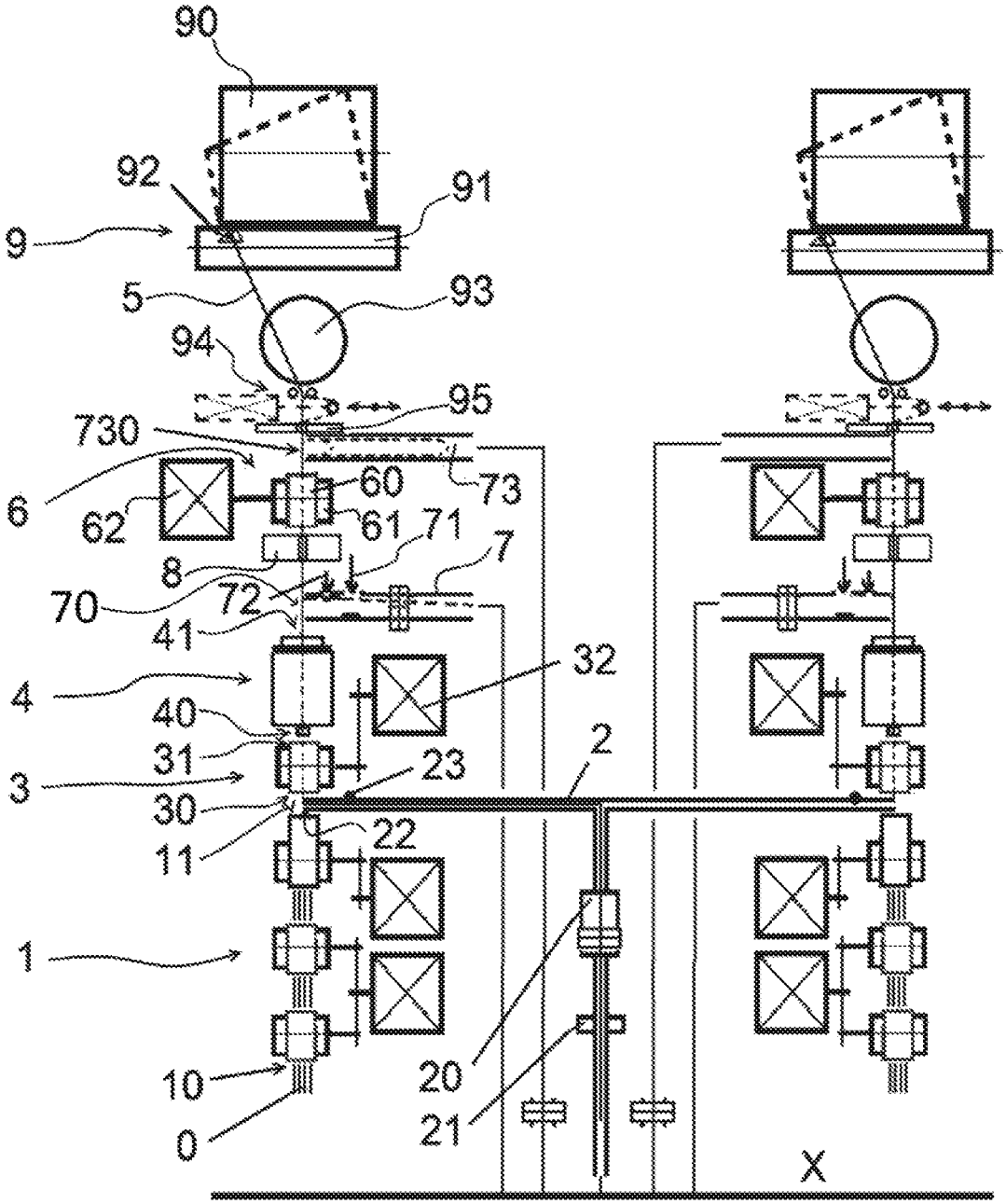
90
92
91
9
5
93
94
95
730
73
6
60
62
61
71
7
8
70
72
41
32
4
40
31
2
3
23
30
22
11
1
20
10
21
0
X

METHOD FOR PREPARING A WORKSTATION FOR RESUMPTION OF THE SPINNING PROCESS ON AN AIR-JET SPINNING MACHINE, AND AN AIR-JET SPINNING MACHINE FOR PERFORMING THE METHOD

TECHNICAL FIELD

The invention relates to a method for preparing a workstation for the resumption of the spinning process on an air-jet spinning machine. After an interruption in the spinning process has occurred, the yarn is guided back to its working path behind a spinning nozzle, or the yarn with the end of yarn in the working path behind the spinning nozzle is stopped in a controlled manner and the yarn end is inserted into an outlet opening of the spinning nozzle. The yarn is then transported by a reverse motion with the aid of the spinning nozzle and a fiber feeding device as far as to a guide channel before the spinning nozzle, where a spinning-in yarn end is formed on the yarn in the guide channel and a yarn reserve starts to form in an underpressure yarn storage device in front of a yarn winding device.

The invention also relates to an air-jet spinning machine with means for preparing a workstation for the resumption of the spinning process, whereby each workstation comprises a sliver drafting mechanism whose outlet is aligned with an inlet of a fiber feeding device having an outlet aligned with an entry of the fibers into a spinning nozzle. The space between the outlet of the sliver drafting mechanism and the inlet of the sliver feeding device is aligned with an exit portion of a guide channel. The guide channel is, at a certain distance from its exit portion, provided with a device for the preparation of the spinning-in yarn end and the workstation is provided with means for the unwinding of the yarn against the direction in which the yarn moves when being formed.

BACKGROUND

Various techniques are used on spinning machines to resume spinning (yarn production), after an interruption of the spinning process has occurred, whether it is after an accidental yarn break, or after a controlled interruption of spinning upon receipt of a signal from a yarn quality sensor or also after the replacement of a fully wound bobbin with an empty tube.

The purpose of the preparation of a workstation for the resumption of the spinning process is to ensure that the individual machine parts of the workstation and, if necessary, also the parts of an attending device, adopt the required position or setting, so that the spinning-in yarn end onto which the spinning-in will take place is prepared, and to ensure that the spinning-in yarn end is situated in a defined initial position for starting the spinning-in process.

In the case of a sudden interruption of spinning, e.g., due to a yarn break, it is generally such a fast process that controlled stopping of the machine workstation cannot be applied and the torn yarn end is wound onto the bobbin. To resume the spinning process, it is necessary to detect the yarn end on the bobbin, by means of an attending device or manually, to remove the defective yarn portion by unwinding it from the bobbin, and to guide the yarn into the working path or to a position in which it can be easily passed on to the workstation means. At the same time, for the resumption of the spinning process, it is necessary for the yarn end to be situated in the so-called transfer position with respect to the spinning nozzle for further operations at the working station and so that it can be delivered to the spinning nozzle for performing the final steps of the preparation of the workstation for the resumption of the spinning process.

Analogous to this situation is also the preparation of the workstation to resume the spinning process after the replacement of a fully wound bobbin with an empty bobbin, when the yarn end is not detected on the wound bobbin, but it is spun onto auxiliary yarn, which is usually carried by the attending device on a bobbin of auxiliary yarn. The attending device prepares the auxiliary yarn so that it could be promptly delivered to the means of the workstation. The end is placed by the attending device into the so-called transfer position for further operations at the working station and for being inserted into the spinning nozzle so that the final steps of the preparation of the workstation of the air-jet spinning machine for the resumption of the spinning process can be performed.

When the interruption of spinning is carried out in a controlled manner, e.g. after a signal from the yarn quality sensor has been produced, the machine parts of the workstation gradually decelerate in a coordinated manner until they come to a complete stop, i.e. to the interruption of spinning, whereby the yarn remains in the working path at the working station, its end being situated in the spinning nozzle, and so it is not necessary to detect it on the bobbin or set it to the so-called transfer position for further operations at the working station and for insertion into the spinning nozzle so as to perform the final workstation preparation steps for the resumption of the spinning process.

The aforementioned final workstation preparation steps consist in delivering the yarn end from the transfer position to the spinning nozzle and then in unwinding the required length of the yarn against the direction of the fiber feed to the spinning nozzle during normal spinning in front of the spinning nozzle, where is arranged a device for the preparation of the spinning-in yarn end, which forms the spinning-in yarn end on the unwound yarn. In the meantime, the other machine parts of the workstation get ready for starting the spinning-in process, including the formation of yarn reserve in an underpressure yarn storage device by the unwinding of the yarn from the bobbin, thus preparing the workstation for the resumption of the spinning process.

The above-mentioned techniques are disclosed, for example, in DE 10 2012 108 380 A1.

The problem of the background art is the variability of the position of the spinning-in yarn end formed by the device for the preparation of the spinning-in yarn end, which consequently leads to a deterioration in the uniformity of the piecing parameters. Due to the requirements for the spinning-in, it is also necessary to create a sufficiently long spinning-in yarn end for starting the spinning-in process. Moreover, it is advisable for the device for forming the spinning-in yarn end to be accessible to the machine operators.

SUMMARY OF THE INVENTION

An aim of the invention is therefore to eliminate or at least minimize the disadvantages of the background art. Additional objects and advantages of the invention will be set forth in part in the following description, or may be obvious from the description, or may be learned through practice of the invention.

The aim of the invention is achieved by a method for preparing a workstation to resume the spinning process on an air-jet spinning machine, whose principle consists in that a reverse motion of yarn to a guide channel is performed by the reverse motion of a drawing-off mechanism of workstation yarn.

The principle of the air-jet spinning machine with means for the preparation of the workstation to resume the spinning process consists in that the workstation is provided with means for a controlled reverse displacement of the formed spinning-in yarn end through the guide channel to a defined position behind the device for the preparation of the spinning-in yarn end in the guide channel.

The advantage of this invention is the fact that it permits to place the spinning-in yarn end exclusively by the means of the workstation in a defined and guaranteed position before starting the spinning-in process, which enables to achieve more uniform parameters of the piecers at one workstation, as well as at different workstations. The invention also provides easy access of the machine operators to the device for forming the spinning-in yarn end. In addition, it allows forming a sufficiently long end of yarn with a spinning-in end.

BRIEF DESCRIPTION OF DRAWINGS

The invention is schematically represented in the drawing which shows an arrangement of a workstation of an air-jet spinning machine.

EXAMPLES OF EMBODIMENT

The invention will be described on an example of embodiment of a workstation of an air-jet spinning machine, which comprises at least one row of identical workstations arranged next to each other.

The workstation comprises a drafting mechanism 1 of sliver 0, which has an inlet 10 aligned with an unillustrated source of sliver and an outlet 11 aligned with the inlet 30 of the fiber feeding device 3, which is coupled to a drive 32. The fiber feeding device 3 has an outlet 31 aligned with the entry 40 to the spinning nozzle 4. In the spinning nozzle 4, the entering sliver 0 is converted into yarn 5, which is drawn off 4 by a drawing-off mechanism 6 arranged behind the yarn 5 outlet opening 41 from the spinning nozzle 4.

The drawing-off mechanism 6 comprises a pair of rollers 60, 61, which are pressed towards each other, whereby one of them is coupled to a rotary drive 62 and the other is rotatably mounted on a pressure arm (not shown), which is tiltably mounted in the construction of the workstation.

Between the outlet opening 41 of the spinning nozzle 4 and the yarn drawing-off mechanism 6 is, in the working path of yarn 5, arranged a suction inlet 70 of a suction tube 7, which is in a controlled manner connected to a source X of underpressure. In the suction tube 7 is arranged a device 71 for interrupting yarn 5 and a device 72 for delivering the end of yarn 5 to the nozzle 4.

Between the suction tube 7 and the yarn drawing-off mechanism 6 is arranged a yarn quality sensor 8, which is connected to the control systems of the workstation and/or a section of workstations and/or of the machine.

A winding device 9 for winding yarn 5 onto a bobbin 90 is disposed in the path of the yarn 5 behind the yarn drawing-off mechanism 6. During winding, the bobbin 90 lies on a drive cylinder 91, which drives it by rolling, whereby the yarn 5 is guided along the width of the bobbin 90 by a guide 92 of the yarn guiding device. In the illustrated embodiment, before the traverse guide 92, the yarn passes through a waxing device 93, in front of which is, in the case conical bobbins being wound, arranged a yarn loop compensator 94 in the path of yarn 5, the yarn loop being formed periodically during the winding of conical bobbins 90. In front of the compensator 94, in the path of yarn 5, is disposed a yarn presence sensor 95, which during the yarn production operates in the mode of a yarn break detector.

Between the yarn presence sensor 95 and the yarn drawing-off mechanism 6, adjacent to the path of yarn 5, with its suction inlet 730 is arranged an underpressure yarn storage device 73, which is connected to an underpressure source X.

For the resumption of the spinning process at the working station in the space between the outlet 11 of the sliver drafting mechanism 1 and the inlet 30 of the feeding device 3 there is an assignable exit portion 22 of a yarn guide channel 2, whereby this exit portion 22 is in the course of normal spinning either completely displaced outside the space between the outlet 11 of the drafting mechanism 1 and the inlet 30 of the feeding device 3, or it is fixed and situated outside the path of the sliver 0. The guide channel 2 is, with its other end, connected to the underpressure source X. The guide channel 2 is, at a distance from its exit portion 22, provided with a device 20 for the preparation of the spinning-in yarn end. In the direction away from the exit portion 22 of an auxiliary guide tube 2 behind the device 20 for the preparation of the spinning-in yarn end, the guide channel 2 is provided with the yarn presence sensor 21.

In the illustrated embodiment, in the space between the inlet 30 of the feeding device 3 and the device 20 for the preparation of the spinning-in yarn end in the guide channel 2, or, more specifically, between the inlet 40 of the spinning nozzle 4 and the device 20 for the preparation of the spinning-in yarn end in the guide channel 2, is arranged a securing element 23 (keeper) of the free yarn end, which is in the illustrated embodiment part of the exit portion 22 of the guide channel 2.

The preparation of the workstation for the resumption of the spinning process after its interruption due to a defect occurring in the produced yarn 5, whereby the defect of yarn 5 is recorded by the yarn quality sensor 8, is performed in such a manner that once the yarn quality sensor 8 has recorded a yarn defect, the workstation starts stopping the spinning process smoothly according to the instructions of a control mechanism (not shown). From the point of view of minimizing the duration of the individual operations at the working station, i.e. the time periods necessary for the individual operations, the individual machine parts of the workstation are braked, or, more specifically, stopped in a controlled way as fast as possible to a complete stop, when the yarn 5 is in its working path, in which it is situated during spinning, its end being situated in the spinning nozzle 4 or above the nozzle 4 in the area of the suction inlet 70 of the suction tube 7.

Subsequently, the suction of yarn by the suction tube 7 is started, by which means the yarn 5 end, situated in the spinning nozzle 4, is pulled out from the spinning nozzle 4 and is sucked into the suction tube 7. After that, the unwinding of the defective portion of yarn 5 from the bobbin 90 is started, when the rotation of the bobbin is reversed against the direction in which yarn 5 is wound onto the bobbin during spinning and, simultaneously, the yarn is drawn off from the bobbin 90 by means of drawing-off rollers 60, 61 rotating reversely. During the unwinding of the defective yarn portion, the defective yarn 5 which is being unwound, passes also through the yarn quality sensor 8 and is sucked into the suction tube 7, which is in a controlled manner connected to the source of underpressure and from which the defective yarn 5 is further sucked off to waste (not shown). Thus, the defective length of yarn 5 is unwound from the bobbin 90 and from the working path at the working station to the waste, whereby it is continuously "cut" by the device 71 for the interruption of yarn 5 in the suction tube 7, so that smaller pieces of defective yarn are sucked off to the waste instead of a long section.

Once the defective yarn 5 has been removed by the suction tube 7, the faultless yarn 5, i.e. the yarn 5 before a defect detection, is already situated in the part of the working path at the working station in the area between the bobbin 90 and the suction tube 7.

Subsequently, the last part of the yarn 5 is separated by the device 71 of in the suction tube 7 and is sucked off to the waste, and consequently the faultless yarn 5 is held by the drawing-off mechanism 6 the end of the faultless yarn being situated in the suction tube 7 in the area of the device 72 for delivering the yarn end to the nozzle 4.

The preparation of the workstation to resume the spinning process after its interruption due to a yarn break is performed in such a manner that an unillustrated attending device detects the yarn end on the bobbin 90, winds it off from the bobbin, and passes it on to the means of the workstation above the nozzle 4. The yarn end created by a break is removed either by the means of the attending device before delivering the yarn 5 to the means of the workstation, or it is removed in the suction tube 7 at the working station, whereby the suction tube 7 separates the last part of the yarn 5 and sucks it off to the waste, so that the faultless yarn 5 is then held by the drawing-off mechanism 6 the end of the faultless yarn being situated in the suction tube 7 in the area of the device 72 for delivering the yarn end to the nozzle 4.

Subsequently, the free end of yarn 5 is moved from the suction tube 7 to the outlet opening 41 of the spinning nozzle 4, e.g., by blowing once the process of suction by the suction tube 7 has been completed, by being sucked into the outlet opening 41 of the spinning nozzle 4 etc.

As soon as the end of the faultless yarn 5 is back in the spinning nozzle 4 another phase of unwinding the yarn 5 is started with the aid of the reverse motion of the yarn drawing-off mechanism 6, i.e. the motion in the direction against the direction of the motion of the yarn 5 during yarn 5 formation, through the spinning nozzle 4, the feeding device 3 to the exit portion 22 of the guide channel 2 and to the securing element 23 (keeper) of the yarn free end and further on to the yarn guide channel 2.

The sliver feeding device 3 is open, i.e. the pressure feed roller is lifted off.

The purpose of the unwinding of the faultless yarn 5 to the guide channel 2 is to form a sufficient length of the faultless yarn 5 for the subsequent realization of spinning-in and formation of a high-quality piecer. Creating this length of the faultless yarn 5 for support is either measured during the unwinding of the yarn 5, e.g., by the number of the revolutions of the drawing-off rollers 60, 61, rotating reversibly, or by measuring the duration of the reverse motion of the yarn drawing-off mechanism 6, or it is signaled by the yarn presence sensor 21 in the guide channel 2. At the moment of signaling the sufficient length of the faultless yarn 5 in the guide channel 2 the speed of the drawing-off mechanism 6 decreases in relation to the speed of the bobbin 90 rotation, whereby the speed of the drawing-off mechanism 6 decreases to a complete stop. Thus, due to the difference in the speeds of yarn 5 in the drawing-off mechanism 6 on the bobbin 90 being unwound, a yarn 5 loop is formed. The yarn 5 loop is sucked into the underpressure yarn storage device 73 as yarn 5 reserve for the start-up of the individual machine parts of the workstation during the process of spinning-in, especially for the start-up of the winding device 9 of yarn 5. Stopping the drawing-off mechanism 6 results in the stopping of the faultless yarn 5 in the guide channel 2.

In front of the yarn presence sensor 21, a spinning-in yarn end is formed by the device 20 for the preparation of yarn 5 in the guide channel 2. During the formation of the spinning-in yarn end, the speed of unwinding the yarn 5 from the bobbin 90, in case of need, increases or decreases by means of the rotation of the bobbin 90 so as to form the required length of the yarn 5 reserve in the underpressure yarn storage device 73 for the start-up of the individual machine parts of the workstation during spinning-in. At the same time so as to avoid overfilling the storage device, or, optionally, the unwinding of the yarn 5 from the bobbin 90 is stopped during the formation of the spinning-in end of yarn 5 in the guide channel 2.

The yarn presence sensor 21 in the guide channel 2 registers the suction of the torn yarn end in the device 20 for the preparation of the spinning-in end of yarn in the guide channel 2, by which means the formation of the spinning-in yarn end is confirmed.

Subsequently, the formed spinning-in yarn 5 end is moved by the reverse motion of the yarn drawing-off mechanism 6 to the yarn presence sensor 21 in the guide channel 2, or behind the yarn presence sensor 21 in the guide channel 2, and consequently the spinning-in yarn end is moved further on in the direction of its insertion into the guide channel 2 behind the device 20 for the preparation the spinning-in yarn end, i.e. to the position behind the place of the formation of the spinning-in yarn end. In this phase, the drawing-off mechanism 6 has preferably the same speed as the bobbin 90 (the unwinding of the yarn from the bobbin 90), therefore the reserve of the yarn 5 in the underpressure yarn storage device 73 is not changed significantly. If the drawing-off mechanism 6 has in this phase a different speed than the bobbin 90 (the unwinding of the yarn from the bobbin 90), the yarn 5 reserve in underpressure yarn storage device 73 is not changed and it has to be subsequently regulated (restocked, reduced) for the subsequent process of spinning-in with a defined length of the yarn reserve in underpressure yarn storage device 73.

Afterwards, the unwinding of the yarn 5 is terminated and the yarn is then arranged at the working station along the entire length from the bobbin 90 to the sliver feeding device 3 in its working path, and in the guide channel 2 is arranged the defined length of yarn 5 with a spinning-in end on the level or behind the level of the yarn presence sensor 21 in the guide channel 2. At that point, all the machine parts of the workstation are stopped and are prepared for the start-up of the spinning-in process, including the pressure feed roller being moved to the position for spinning-in.

During the first phase of the unwinding of the yarn 5, i.e. unwinding to the suction tube 7, the spinning nozzle 4 is cleaned at the workstation and the spinning nozzle 4 is prepared for the second phase of the unwinding of the yarn 5, i.e. the unwinding of the yarn 5 to the guide channel 2, whereupon the preparation for spinning-in and spinning is carried out. During the first and/or also the second phase of the unwinding of the yarn 5 at the working station, those machine parts of the workstation which do not take part in the unwinding are prepared for the spinning-in process and at the same time the preparation of sliver 0 for spinning-in is performed.

The invention can be used on textile machines for the preparation of a workstation for the resumption of the spinning process.

The invention claimed is:

1. A method for preparing of a workstation of an air-jet spinning machine for the resumption of a yarn spinning process after an interruption wherein the yarn is guided back to a working path downstream of a spinning nozzle, or the yarn is stopped in a controlled manner in the working path with an end of the yarn situated downstream of the spinning nozzle, comprising:

inserting the yarn end into an outlet opening of the spinning nozzle and transporting the yarn in a reverse motion through the spinning nozzle and a fiber feeding device to a guide channel disposed before the spinning nozzle;

forming a spinning-in yarn end on the yarn in the guide channel;

forming a yarn reserve in an underpressure yarn storage device in front of a yarn winding device; and wherein the reverse motion of the yarn to the guide channel is provided primarily by reverse motion of a yarn drawing-off mechanism at the workstation.

2. The method according to claim 1, wherein the reverse motion of the yarn to the guide channel continues after creating the spinning-in yarn end in the guide channel, the yarn with its defined spinning-in yarn end moved further in direction of insertion into the guide channel by a defined distance beyond where the spinning-in yarn end is formed in the guide channel.

3. The method according to claim 2, wherein displacement of the spinning-in yarn end in the guide channel beyond where the spinning-in yarn end is formed is monitored and controlled by a yarn presence sensor in the guide channel.

4. The method according to claim 3, wherein displacement of the spinning-in yarn end in the guide channel beyond where the spinning-in yarn end is formed is stopped when the spinning-in yarn end is detected by the sensor.

5. The method according to claim 3, wherein displacement of the spinning-in yarn end in the guide channel beyond where the spinning-in yarn end is formed is stopped after a defined time interval after the spinning-in yarn end of yarn is detected by the sensor.

6. The method according to claim 3, wherein passage of a separated part of the yarn generated when forming the spinning-in yarn end in the guide channel past the sensor is detected by the sensor and confirms formation of the spinning-in yarn end.

7. The method according to claim 3, wherein the sensor is common to at least two workstations.

8. An air-jet spinning machine with a workstation configured for resumption of a yarn spinning process, comprising:

a sliver drafting mechanism;

a fiber feeding device, an outlet of the sliver drafting mechanism aligned with an inlet of the fiber feeding device;

a spinning nozzle, an outlet of the fiber feeding device aligned with an entry to the spinning nozzle;

a guide channel, the guide channel comprising an exit portion aligned with a space between the outlet of the sliver drafting mechanism and the inlet of the fiber feeding device;

a device configured in the guide channel at a distance from the exit portion, the device configured to prepare a spinning-in yarn end;

means for unwinding of the yarn against a direction in which the yarn moves during formation in the spinning process; and means for controlled reverse displacement of the spinning-in yarn end through the guide channel to a defined position beyond the device for the preparation of the spinning-in yarn end in the guide channel.

9. The air jet spinning machine according to claim 8, further comprising a yarn presence sensor in the guide channel at a defined distance from the exit portion of the guide channel in the direction beyond the device for the preparation of the spinning-in yarn end, the sensor connected to a work station control mechanism.

10. The air-jet spinning machine according to claim 8, further comprising a yarn end securing element arranged between the device for the preparation of the spinning-in yarn end and the inlet of the spinning nozzle.

* * * * *